US012134023B2

(12) United States Patent
Cunningham

(10) Patent No.: US 12,134,023 B2
(45) Date of Patent: Nov. 5, 2024

(54) SCOREBOARD FOR PLATFORM TENNIS

(71) Applicant: Marian Gallo Cunningham, Morristown, NJ (US)

(72) Inventor: Marian Gallo Cunningham, Morristown, NJ (US)

( * ) Notice: Subject to any disclaimer, the term of this patent is extended or adjusted under 35 U.S.C. 154(b) by 762 days.

(21) Appl. No.: 17/242,761

(22) Filed: Apr. 28, 2021

(65) Prior Publication Data

US 2022/0347550 A1 Nov. 3, 2022

(51) Int. Cl.
*A63B 71/06* (2006.01)
*A63B 102/08* (2015.01)

(52) U.S. Cl.
CPC ..... *A63B 71/0672* (2013.01); *A63B 2102/08* (2015.10)

(58) Field of Classification Search
CPC .. A63B 71/0672; A63B 2102/08; A63B 59/40
See application file for complete search history.

(56) References Cited

U.S. PATENT DOCUMENTS 434,425 A * 8/1890 Cooper ..... A63B 71/0672 473/553
448,878 A * 3/1891 Clarke ..... A63B 67/002 116/225
544,907 A * 8/1895 Braine ..... A63B 71/0672 235/1 B
1,985,652 A * 12/1934 Campbell ..... A63B 71/0672 235/114
2,477,825 A 8/1949 Richardson
D174,035 S * 2/1955 Gibson ..... D10/46.1
3,254,433 A * 6/1966 Saile, Jr. ..... A63B 71/06 473/192
3,299,775 A 1/1967 Miller
3,730,131 A * 5/1973 Izzo ..... A63B 71/0672 235/114
3,777,699 A * 12/1973 Pfleger ..... A63B 71/0672 235/113
4,045,023 A 8/1977 Heffley, Jr.
4,165,710 A * 8/1979 Gaetano ..... A63B 71/0672 235/114
4,189,143 A * 2/1980 Van Auken ..... A63B 71/0672 235/1 B (Continued)

OTHER PUBLICATIONS

JP-2016099530-A; Yamada et al., "Plate Signboard Mounting Device for Fence", 2016. (Year: 2016).*

*Primary Examiner* — John Fitzgerald
*Assistant Examiner* — Tania Courson
(74) *Attorney, Agent, or Firm* — Dunlap Bennett & Ludwig, PLLC

(57) ABSTRACT

A paddle scoreboard for platform tennis is provided. The paddle scoreboard is paddle shaped and adapted to engage and hang from the fence of the platform tennis court. The paddle scoreboard includes two paddle plates that sandwich two scoring discs and two set discs that are rotatably connected to and between the paddle plates. Four apertures are provided by the paddle plates so that one of a plurality of indicia for each of the four discs are viewable through each aperture. A peripheral portion of each disc protrudes beyond the perimeter of the paddle plates so that each disc is selectively spinnable for indicating the game and set score through the four apertures.

6 Claims, 3 Drawing Sheets

(56) References Cited

U.S. PATENT DOCUMENTS 4,227,692 A * 10/1980 Castelli ..... A63B 60/40 473/525
4,257,602 A 3/1981 Seath
4,280,291 A * 7/1981 Maynes ..... A63B 71/0672 40/495
4,840,376 A 6/1989 Garret
4,884,816 A 12/1989 Ford et al.
5,069,460 A 12/1991 Kulesza
D342,457 S * 12/1993 Morrison ..... D10/46.1
5,329,874 A * 7/1994 Posey ..... G09F 7/02 273/DIG. 26
5,489,122 A * 2/1996 Pittner ..... A63B 71/0672 116/323
5,702,102 A 12/1997 Ballard
7,117,619 B1 * 10/2006 Huber ..... G09F 11/04 40/604
7,404,373 B2 7/2008 Bailey
7,517,293 B1 * 4/2009 Smith ..... A63B 49/00 273/DIG. 26
D601,046 S * 9/2009 Cowen ..... D10/46.1
8,607,725 B2 12/2013 Degirmenci
D774,403 S * 12/2016 Iler ..... D10/46.1
10,376,766 B2 8/2019 Stanfield et al.
2004/0005534 A1 1/2004 Vickroy
2004/0016391 A1 * 1/2004 Gordon ..... A63B 71/0672 116/318
2007/0074650 A1 * 4/2007 Bailey ..... A63B 71/0672 116/223
2008/0167145 A1 * 7/2008 Madzuma ..... A63B 67/20 473/527
2012/0256373 A1 10/2012 Tam et al.
2012/0323823 A1 * 12/2012 Albers ..... A63B 59/48 235/487
2018/0264345 A1 9/2018 Kim
2018/0268341 A1 9/2018 Rini et al.
2019/0192953 A1 6/2019 Thakkar

* cited by examiner

SCOREBOARD FOR PLATFORM TENNIS

BACKGROUND OF THE INVENTION

The present invention relates to platform tennis and, more particularly, a scoreboard for platform tennis.

Platform tennis, often called "paddle", is a game derived from tennis but developed to be played outside in inclement weather on land unsuitable for traditional tennis courts. As a result, the platform tennis court is one-third the size of a traditional tennis court and is surrounded by a chicken wire fence 12 feet high. The taut fencing allows balls to be played off the wall and remain in play.

Current platform tennis scoreboards are makeshift efforts that tend to freeze up in cold weather and have trouble accounting for the wire fence, which not only surrounds the court, but defines the bounds of the court, and is in fact is part of the court. Accordingly, current platform tennis scoreboards tend to either freeze in the cold weather or have difficulty attaching to the court fence without interfering with the play of game/ball. As a result, keeping score during a platform tennis match can be frustrated (scoreboard freezes up) or frustrating (interfering with game play).

As can be seen, there is a need for a scoreboard specifically for platform tennis, wherein present invention embodies a unique two-sided scoring wheel that is practical in cold weather and that is adapted to hang on a wire fence within the paddle court.

SUMMARY OF THE INVENTION

In one aspect of the present invention, a tennis-based scoreboard includes the following: two paddle plates connected so that a plurality of scoring discs rotatably connected to at least one of the two paddle plates, wherein each paddle plate is paddle shaped, and wherein a peripheral portion of each of the plurality of scoring discs protrudes beyond a perimeter of the two paddle plates; and an aperture in at least one paddle for each of the plurality of scoring discs, wherein one of a plurality of indicia of each scoring disc is selectively visible therethrough.

In another aspect of the present invention, the tennis-based scoreboard of further includes wherein the two paddle plates are generally coextensive and form a paddle shape comprising a head portion and a handle portion; and further including a top spacer interconnecting the head portions of the two paddle plates; and a bottom spaced interconnecting the handle portions of the two paddle plates; and including at least one protruding fastener extending perpendicularly away from one of the two paddle plates, wherein the plurality of scoring discs comprises two game scoring discs and two set scoring discs; and the apertures comprise two spaced apart pairs of apertures.

These and other features, aspects and advantages of the present invention will become better understood with reference to the following drawings, description and claims.

DETAILED DESCRIPTION OF THE INVENTION

Figure 2:
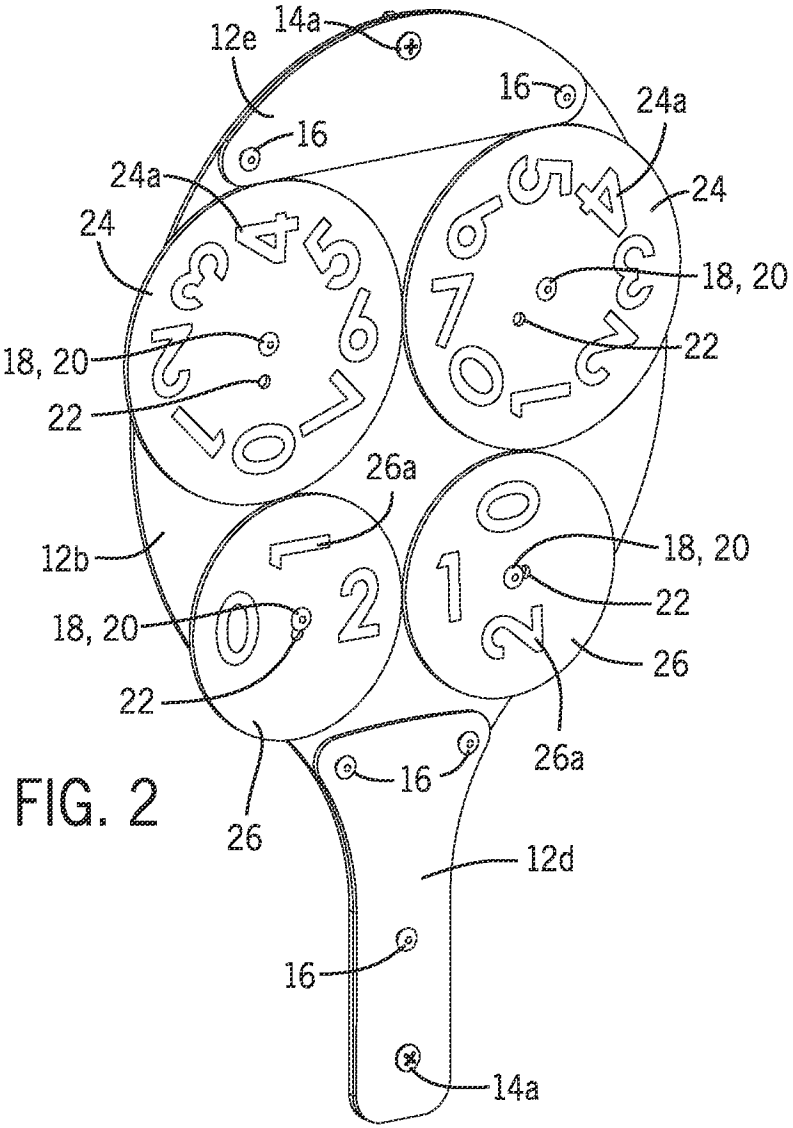
FIG. 2 is a front perspective view of an exemplary embodiment of the present invention, with one paddle side removed for clarity.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a paddle scoreboard for platform tennis. The paddle scoreboard is paddle shaped and adapted to engage and hang from the fence of the platform tennis court. The paddle scoreboard includes two paddle plates that sandwich two scoring discs and two set discs that are rotatably connected to and between the paddle plates. Four apertures are provided by the paddle plates so that one of a plurality of indicia for each of the four discs are viewable through each aperture. A peripheral portion of each disc protrudes beyond the perimeter of the paddle plates so that each disc is selectively spinnable for indicating the game and set score through the four apertures.

Referring now to FIGS. 1 through 5, the present invention may include a paddle scoreboard 10 for platform tennis. The paddle scoreboard 10 may include a paddle plate 12 comprising a first paddle plate 12*a* and second paddle plate 12*b* that sandwich two scoring discs 24 and two set discs 26 for keep score of the games and set of a platform tennis match. The paddle plate 12 may include top spacer 12*e* and a handle spacer 12*d* sandwiched between the first paddle plate 12*a* and the second paddle plate 12*b* to accommodate the two scoring discs 24 and the two set discs 26 so that that latter can operatively associate with the first paddle plate 12*a* and the second paddle plate 12*b*.

Each scoring disc 24 may have scoring indicia 24*a* radially orientated just inward the circumference of the scoring disc 24. The scoring indicia 24*a* may be the sequential numbers zero through seven. Each set disc 26 may have set indicia 26*a* radially orientated just inward the circumference of the set disc 26. The set indicia 26*a* may be the sequential numbers zero through two. Each scoring and set disc 24 and 26 may have a pivot point 20 about which each disc 24 and 26 is rotatably connected to the first paddle plate 12*a* that second paddle plate 12*b*. Pivots 18 may operatively associate the pivot points 20 to the first paddle plate 12*a* and the second paddle plate 12*b*.

Each scoring disc and each set disc 24 and 26 may have an indexing point 22 spaced apart from the pivot point 20, the latter being at the center of the disc 24 or 26. Both the scoring and set discs 24 and 26 may have an eccentrically placed (e.g., drilled) hole/indexing point 22 that is used to align the screen-printed numbers on both sides of the discs 24 and 26 during the application of the scoring indicia 24*a* and the set indicia 26*a* (for example, during a screen-printing process). This is because the scoring indicia 24*a* and the set indicia 26*a* (e.g., scoring/set numbers) must be aligned so they read the same when viewed from both sides of the present invention. A fixture with a concentric pin and an eccentric pin positions both types of discs 24 and 26 during screen-printing to accomplish the required alignment when screen-printing both sides of each disc 24 and 26.

Each paddle plate 12*a* and 12*b* has a paddle shape with an oval planar head portion and an elongated planar handle portion as shown in the FIGS., and thereby the overall paddle plate 12 has the same paddle shape. The paddle plate 12*a* and 12*b* may be connected to each other along their respective peripheries by way of spaced apart fasteners 14*a* and 16, which may include but not be limited to machine screws and assembly rivets, respectively, or any fasteners that join two objects together. Moreover, protruding fasteners 14*b* are attached toward the top of the head portion and toward the bottom of the handle portion of the paddle plate 12. The protruding fasteners 14*b* may be a wingnut or the like, thereby providing structure to engage and hang the present invention from the wire fence 28 of a platform tennis court.

Each paddle plate 12*a* and 12*b* may have two pairs of apertures 12*c* through which a portion of the scoring indicia 24*a* and the set indicia 26*a* may be visible. The scoring and set discs 24 and 26 are rotatably connected to the first paddle plate 12*a* and the second paddle plate 12*b* by way of the pivots 18 so that when the scoring indicia 24*a* and the set indicia 26*a* may be selectively moved so that a desired number is viewable or visible through each of the relevant pair apertures 12*c*. Each aperture of the pair of apertures 12*c* is associated with one of the two players of platform tennis.

Figure 1:
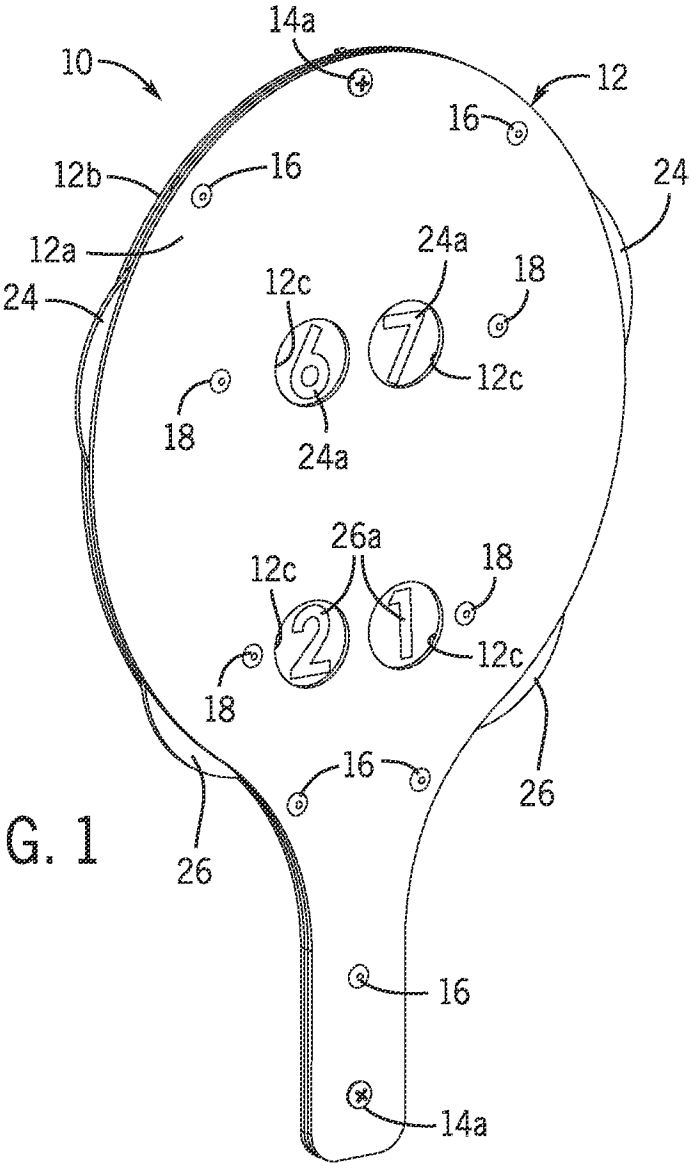
FIG. 1 is a front perspective view of an exemplary embodiment of the present invention.
Figure 3:
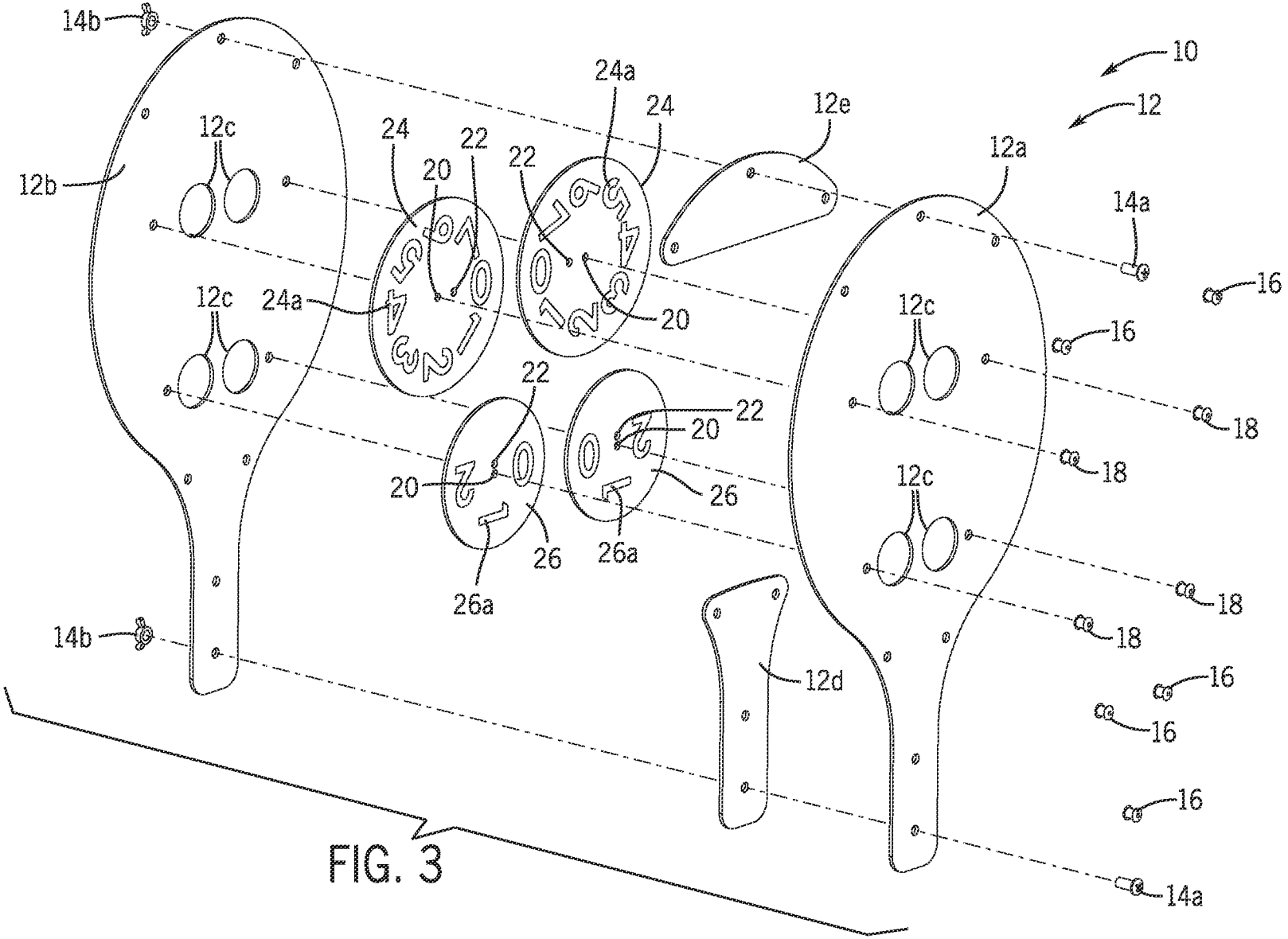
FIG. 3 is an exploded perspective view of an exemplary embodiment of the present invention.
Figure 5:
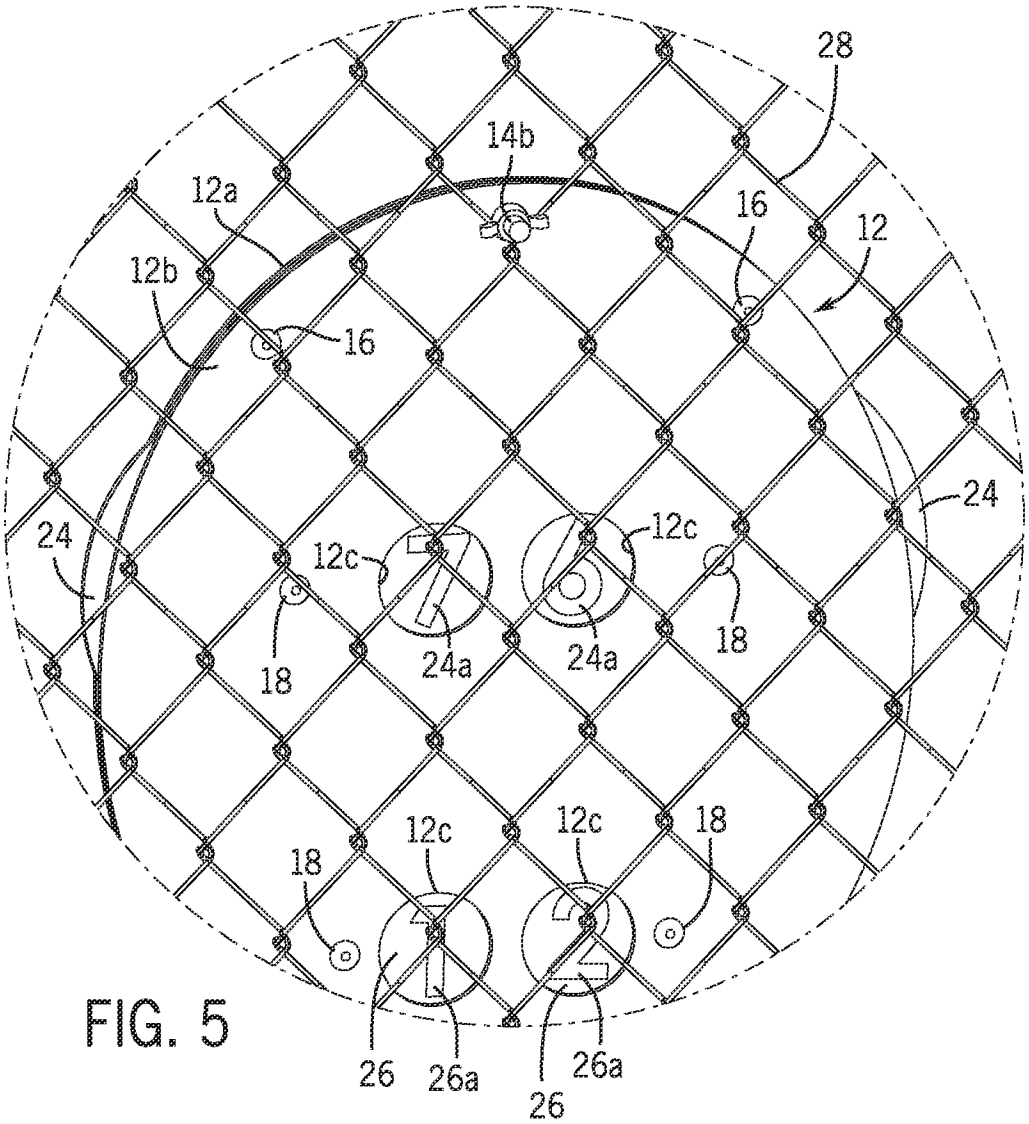
FIG. 5 is a detailed perspective view of an exemplary embodiment of the present invention, shown in use attached to a fence.
Figure 4:
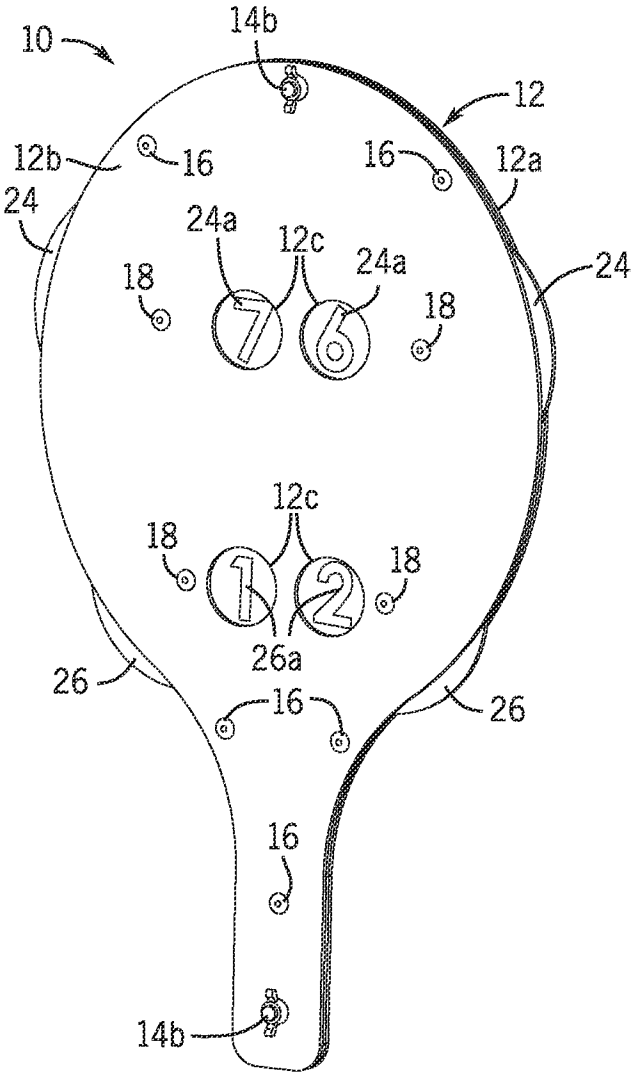
FIG. 4 is a rear perspective view of an exemplary embodiment of the present invention.

A method of using the present invention may include the following. The paddle scoreboard 10 disclosed above may be provided. A user may selectively spin the circumferences of the scoring and set discs 24 and 26—which are dimensioned and adapted to protrude beyond the perimeter of the first paddle plate 12*a* and the second paddle plate 12*b*, as illustrated in FIG. 1—to adjust the game and set scores during a platform tennis match.

The paddle scoreboard 10 hangs inside the wire fence 28 thereby enabling the above-mentioned adjustable scoring by the players. As the inside of the fence 28 is "in play," the paddle shape of the paddle plate 12 increases the players chances of reacting to a ball that hits the paddle scoreboard 10, since players are accustomed to a ball hitting a paddle, as opposed to other shapes of current platform tennis scoreboards.

It should be understood, of course, that the foregoing relates to exemplary embodiments of the invention and that modifications may be made without departing from the spirit and scope of the invention as set forth in the following claims.

What is claimed is:

1. A platform tennis scoreboard for hanging from court-facing surface of a wire fence surrounding a platform tennis court, comprising:

two paddle plates connected so that a plurality of rotatable two-sided scoring discs is sandwiched between the two paddle plates, wherein each paddle plate is paddle shaped, and wherein a peripheral portion of each of the plurality of scoring discs protrudes beyond a perimeter of the two paddle plates;

in each paddle plate, an aperture associated with each of the plurality of scoring discs, wherein one of a plurality of indicia of each scoring disc is selectively visible therethrough; and a protrusion projecting from a spectator-facing paddle plate of the two paddle plates, wherein the protrusion is centrally disposed along an upper portion of a face of said spectator-facing paddle plate so that when the platform tennis scoreboard is hung from said wire fence, the spectator-facing paddle plate is in a parallel orientation with the said wire fence, whereby each of the plurality of indicia are visible through the associated apertures simultaneously for those on and outside of the platform tennis court, respectively, and whereby an in-play ball hitting the platform tennis scoreboards hits a court-facing paddle plate of the two paddle plates.

2. The platform tennis scoreboard of claim 1, wherein the two paddle plates are generally coextensive, each define a head portion and a handle portion.

3. The platform tennis scoreboard of claim 2, further comprising:

a top spacer interconnecting the head portions of the two paddle plates; and a bottom spacer interconnecting the handle portions of the two paddle plates.

4. The platform tennis scoreboard of claim 3, wherein the protrusion comprises a fastener that journals through the two paddle plates and the top spacer.

5. The platform tennis scoreboard of claim 4, wherein the plurality of rotatable two-sided scoring discs comprises two game scoring discs and two set scoring discs; and the apertures comprise two spaced apart pairs of apertures.

6. The platform tennis scoreboard of claim 4, wherein the protrusion further comprises a wingnut.

* * * * *